US010011998B1

(12) United States Patent
Dantzer

(10) Patent No.: US 10,011,998 B1
(45) Date of Patent: Jul. 3, 2018

(54) MODULAR PATIO ASSEMBLY

(71) Applicant: Hugh A. Dantzer, Edmonton (CA)

(72) Inventor: Hugh A. Dantzer, Edmonton (CA)

( * ) Notice: Subject to any disclaimer, the term of this patent is extended or adjusted under 35 U.S.C. 154(b) by 0 days.

(21) Appl. No.: 15/731,595

(22) Filed: Jul. 6, 2017

(51) Int. Cl.
*E04F 15/02* (2006.01)
*E04B 1/343* (2006.01)
*E04F 15/18* (2006.01)

(52) U.S. Cl.
CPC .... *E04F 15/02183* (2013.01); *E04B 1/34315* (2013.01); *E04B 1/34352* (2013.01); *E04F 15/02044* (2013.01); *E04F 15/02138* (2013.01); *E04F 15/18* (2013.01); *E04F 2015/02083* (2013.01)

(58) Field of Classification Search
CPC ..... E04F 15/02183; E04F 15/02044; E04F 15/02138; E04F 15/18; E04F 2015/02083; E04F 15/166; E04F 15/182; E04B 1/34352; E04B 1/34315; E01C 9/00; E01C 9/08; E01C 9/083; E01C 9/086
USPC ..... 404/34, 35, 36, 43, 46
See application file for complete search history.

(56) References Cited

U.S. PATENT DOCUMENTS 4,568,587 A * 2/1986 Balzer ..... A47L 23/26 428/192
4,622,792 A * 11/1986 Betts ..... E04B 5/12 52/263
5,303,526 A * 4/1994 Niese ..... E04F 15/04 52/393
5,323,575 A * 6/1994 Yeh ..... E04F 15/02 52/177
5,482,755 A * 1/1996 Manning ..... A44B 18/00 428/100
5,486,392 A * 1/1996 Green ..... A47L 23/26 15/215
6,182,414 B1 * 2/2001 Huang ..... E04F 15/182 403/354
6,395,362 B1 * 5/2002 Pacione ..... A47G 27/0293 428/100
6,434,779 B1 * 8/2002 Bartlett ..... A47L 23/26 15/161
6,460,303 B1 * 10/2002 Pacione ..... A47G 27/025 428/100
7,140,156 B1 * 11/2006 Lowe, Jr. ..... E04F 15/02183 411/457
9,038,324 B2 * 5/2015 Kugler ..... E04F 15/02464 52/126.6
9,752,326 B2 * 9/2017 Kraus, Jr. ..... E04D 5/144
2003/0070391 A1 * 4/2003 Tachauer ..... A44B 18/0049 52/745.21
2005/0257483 A1 * 11/2005 Wilhelmsson .... E04F 15/02183 52/650.3
2006/0222804 A1 * 10/2006 Banting ..... E01C 9/086 428/54

(Continued)

*Primary Examiner* — Joshua J Michener
*Assistant Examiner* — Matthew J Gitlin
(74) *Attorney, Agent, or Firm* — George A. Seaby

(57) ABSTRACT

A module patio assembly includes a groundsheet formed of landscape fabric, parallel wooden sleepers connected to and extending transversely of the groundsheet, and parallel row of prefabricated deck tiles mounted on the sleepers. Cooperating hook and eye fasteners are provided on the top surfaces of the sleepers and on the bottom surfaces of the deck tiles for securing the deck tiles to the sleepers.

11 Claims, 11 Drawing Sheets

(56) References Cited

U.S. PATENT DOCUMENTS

| | | | | |
|---|---|---|---|---|
| 2009/0266022 | A1* | 10/2009 | Lin | E04F 15/10 52/506.1 |
| 2010/0251641 | A1* | 10/2010 | Gallagher | E04F 15/18 52/177 |
| 2012/0090256 | A1* | 4/2012 | Andrews | E04F 15/02044 52/263 |
| 2013/0123033 | A1* | 5/2013 | Sievanen | A63D 5/00 473/116 |
| 2015/0345155 | A1* | 12/2015 | Pastrana | E04F 15/187 428/40.5 |

* cited by examiner

MODULAR PATIO ASSEMBLY

FIELD OF INVENTION

This invention relates to a modular patio assembly.

BACKGROUND OF THE INVENTION

U.S. Pat. No. 9,145,673 which issued to Hugh A. Dantzer on Sep. 29, 2015, discloses a modular deck assembly including a deck clip. As described in the Dantzer patent, modular decks and clips used as connectors in such decks are by no means new. An example of a modular deck is described in U.S. Pat. No. 6,209,267, which issued to Hugh A. Dantzer on Apr. 3, 2001. The patents listed on the cover page of the Dantzer patent disclose modular deck systems and connectors used in the construction of such systems. In general, the modular deck systems are somewhat complicated and rely on specially designed connectors for assembling the systems. The inventor found that there was a need for a deck system which could be quickly assembled without specially designed planks and/or connectors. The modular deck described in the Dantzer patent is quick and easy to assemble.

An object of the present invention is to provide a modular patio assembly which is at least as simple as the Dantzer deck assembly described in U.S. Pat. No. 9,145,673, and which can be quickly constructed without a large number of screws or other fasteners.

SUMMARY OF THE INVENTION

One version of a modular patio assembly in accordance with the present invention includes a groundsheet; at least three parallel sleepers connected to and extending transversely of the groundsheet, including two end sleepers and a central sleeper centered between the end sleepers; two parallel rows of deck tiles connected to the sleepers, each deck tile including furring strips and floorboards connected to the furring strips and extending perpendicular thereto; and cooperating hook and eye fasteners on top surfaces of said sleepers and on bottom surfaces of said furring strips for securing the deck tiles to the sleepers.

Another embodiment of the patio assembly includes a flexible groundsheet adapted to be rolled to form a cylinder; at least three spaced apart sleepers including two end sleepers and an intermediate sleeper between said end sleepers permanently attached to a top surface of the groundsheet; two parallel rows of deck tiles mounted on said sleepers, each deck tile including a rectangular floorboard of sufficient length to partially overlap adjacent sleepers when placed thereon, spacers attached to a bottom surface of said floorboard for extending between side edges of adjacent sleepers when the floorboard is placed on the sleepers; and complementary hook and eye fasteners permanently connected to the top surfaces of said sleepers and to bottom surfaces of said floorboards for connecting said deck tiles to the sleepers.

DETAILED DESCRIPTION OF THE INVENTION

Figure 1:
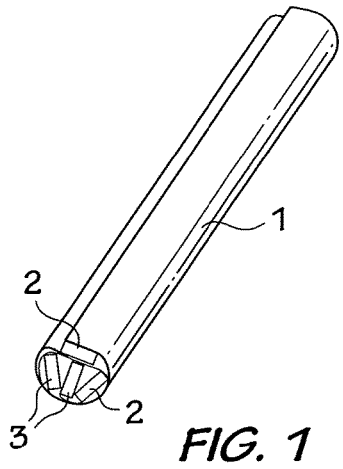
FIG. 1 is an isometric view of a rolled up groundsheet and sleepers used in a modular patio deck assembly in accordance with the invention.
Figure 2:
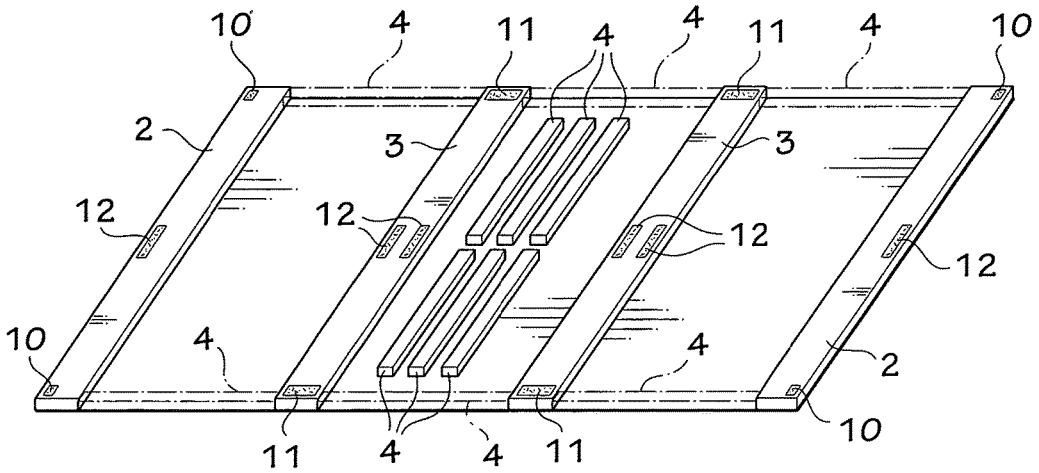
FIG. 2 is an isometric view of the groundsheet and sleepers of FIG. 1 in the unrolled or laid out condition.
Figure 3:
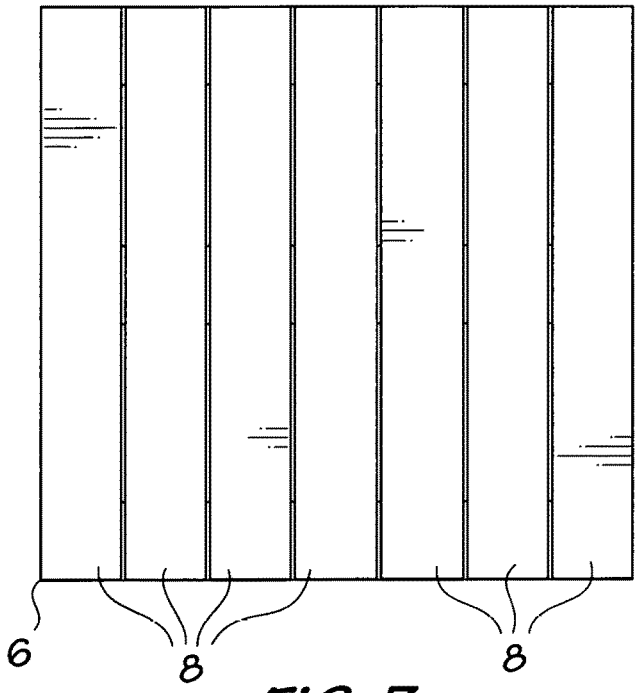
FIG. 3 is a top view of a deck tile used in the patio assembly of the present invention.
Figure 4:
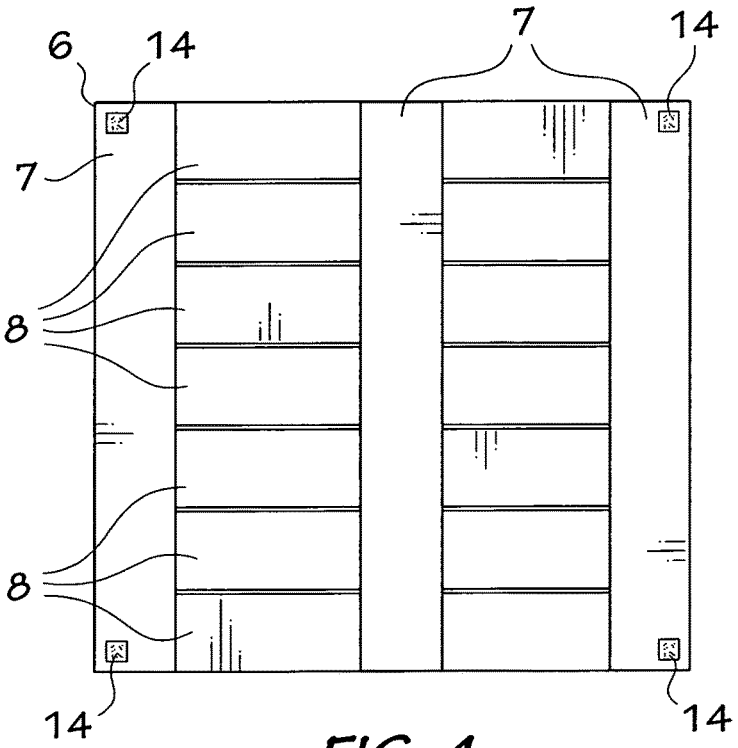
FIG. 4 is a bottom view of the deck tile of FIG. 3.
Figure 5:
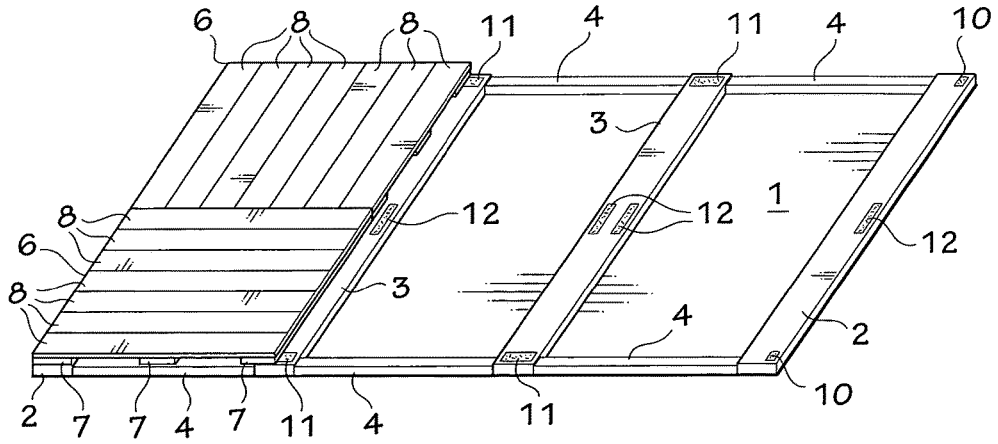
FIG. 5 is an isometric view of a partially constructed modular patio assembly.

With reference to FIGS. 1 to 3, basic elements of the patio assembly include a groundsheet 1 formed of landscape fabric which can be rolled up to form a cylinder, a plurality of spaced apart, parallel sleepers 2 and 3 (FIG. 2) permanently attached to the groundsheet using staples (not shown) or other fasteners, a plurality of spacers 4, and a plurality of pre-assembled, rectangular deck tiles 6 (FIGS. 3 and 4). An end sleeper 2 is attached to each end of the groundsheet 1 and the remaining central sleepers 3 are mounted on the groundsheet 1 between the end sleepers 2. When the groundsheet is unrolled, the spacers 4 are placed on the groundsheet 1 between the ends of the sleepers 2 and 3. The spaces 4 stretch out the groundsheet 1.

With the groundsheet 1 stretched out flat, the deck tiles 6 are mounted on the sleepers 2 and 3. As mentioned above, the deck tiles are rectangular, the preferred shape being square. While the dimensions of the deck tiles can be varied, in the embodiment of the invention shown in FIGS. 1 to 6, each deck tile 6 includes three furring strips 7 and seven 1"×6" floorboards 8 attached to the furring strips with ¼" spacing between the boards. The deck tile 6 is assembled upside down, i.e. the floorboards 8 are placed on a flat surface and the furring strips 7 are nailed to the floorboard 8 using brad nails (not shown), which are not seen when the deck tile 6 is topside up. The furring strips 7 are connected to the ends of the boards 8. In order to releasably connect the deck tiles 6 to the sleepers 2 and 3, hook and eye (Velcro®) fasteners are connected to the sleepers 2 and 3, and to the deck tiles 6. Halves 10 and 11 of the hook and eye fasteners are stapled to the end sleepers 2 and the central sleepers 3, respectively, proximate the ends thereof. Fastener halves 12 are stapled to the middles of the sleepers 2 and 3. The other halves 14 of the fasteners are stapled to the bottoms of the deck tiles 6 proximate the corners thereof. When the deck panels 6 are mounted on the sleepers 2 and 3, the fastener halves 14 are vertically aligned and become attached to the fastener halves 10, 11 and 12 on the sleepers 2 and 3. Whereas the fastener halves 10 and 14 are small rectangular strips, the fastener halves 11 and 12 are longer because they underlap the fastener halves 14 of two adjacent tiles 6 when the tiles are mounted on the sleepers 2 and 3.

Figure 6:
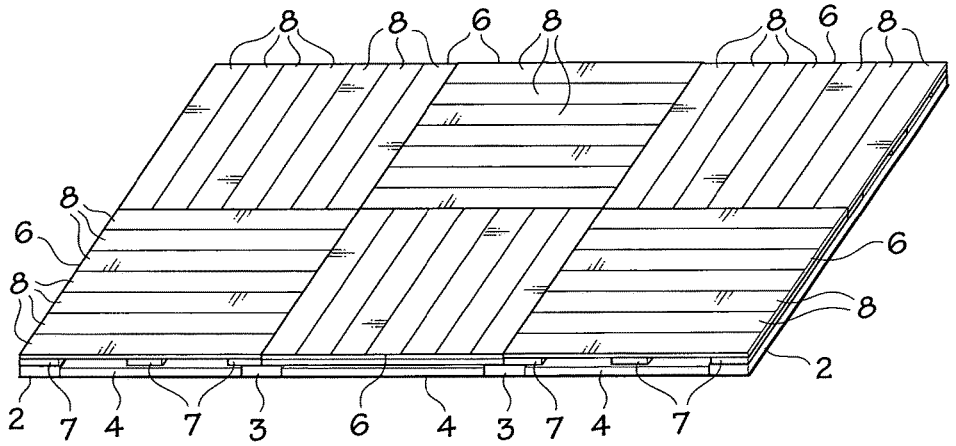
FIG. 6 is an isometric view of the completed patio assembly.
Figure 7:
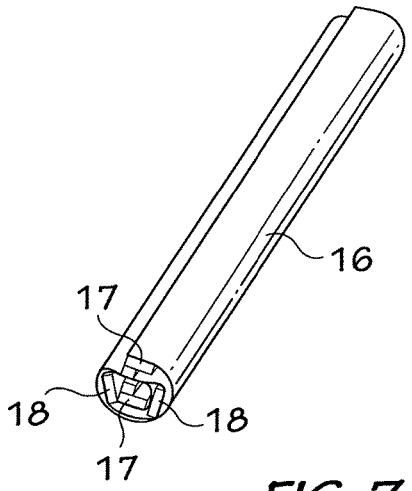
FIG. 7 is an isometric view of a rolled up groundsheet and sleepers used in a second embodiment of the patio assembly.
Figure 8:
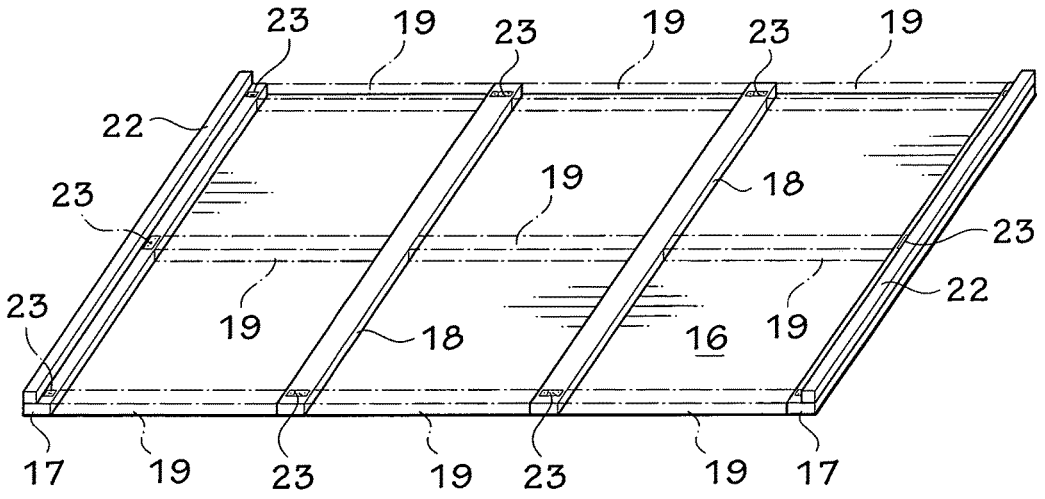
FIG. 8 is an isometric view of the unrolled groundsheet and the sleepers of FIG. 7.

The tiles 6 are mounted on the sleepers 2 and 3 one at a time, starting from one corner of the groundsheet to form the completed patio shown in FIG. 6. Because the tiles 6 are attached to the sleepers 2 and 3 by hook and eye fasteners, the patio can quickly and easily be assembled and disassembled.

With reference to FIGS. 7 to 16, a second embodiment of the patio assembly includes most of the basic elements of the assembly of FIGS. 1 to 6. Whereas the deck assembly of FIGS. 1 to 6 is intended to be readily portable the assembly of FIGS. 7 to 16 is a more permanent structure, which once assembled remains in place indefinitely. The basic elements of the patio assembly of FIGS. 7 to 16 include a groundsheet 16, parallel, spaced apart sleepers 17 and 18 permanently connected to the groundsheet using staples (not shown), a plurality of spacers 19, pre-assembled deck tiles 6 (FIGS. 3 and 4) and deck clips indicated generally at 20. A narrow board 22 defining one end of a border is permanently mounted on and extends the length of each end sleeper 17. Strips 23 of hook and eye fastener halves are attached to the ends of the sleepers 17 and 18, and to the middle of end sleepers 17. Four narrow boards 24, each having a length equal to one-half the distance between the end boards 22 are provided loose with the patio assembly. The boards 24 have a height equal to the thickness of the furring strips 7 and the deck boards 8 combined. The board 24 have pre-drilled holes 25 for receiving screws (not shown) when mounting the boards on the spacers 19 at the ends of the sleepers 17 and 18.

Figure 9:
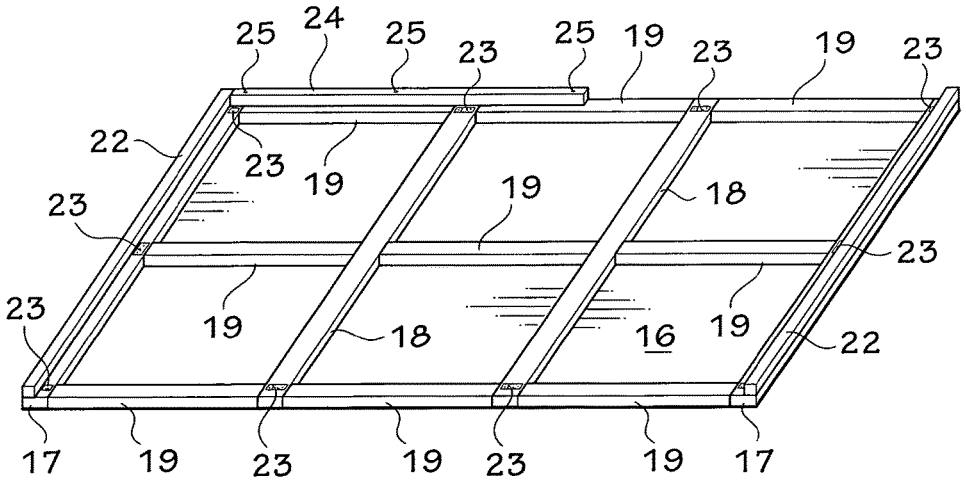
FIGS. 9 and 10 are isometric views of sections of the patio assembly at two stages of construction.
Figure 10:
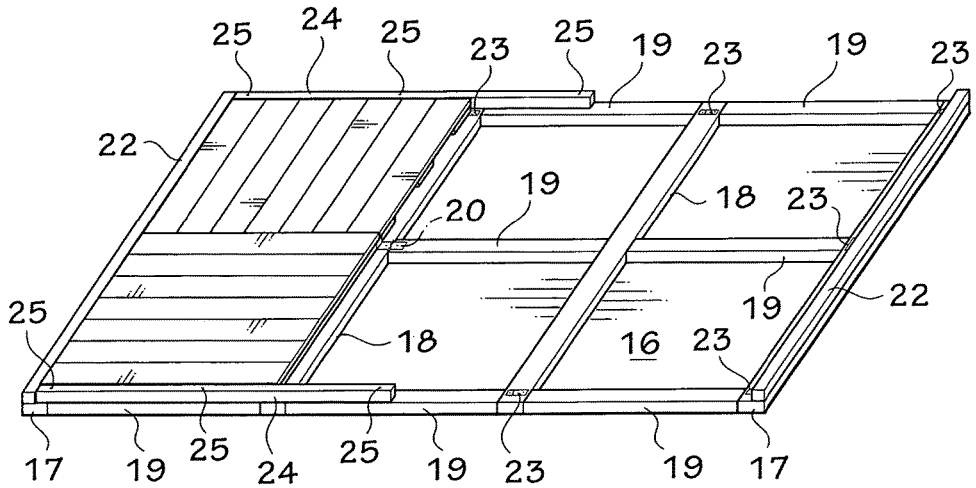

When assembling the patio, the ground sheet 16 is unrolled and the spacers 19 and the boards 24 are removed. The spacers 19 are placed in the position shown in phantom outline in FIG. 8. As shown in FIG. 9, a first of the boards 24 is placed above one side of the groundsheet 16 overlapping one end sleeper 17 and the end of one intermediate sleeper 18. The outside of the board 24 is flush with the ends of the sleepers 17 and 18, and with the outsides of the end spacers 19. The thus positioned board 24 is then screwed to the spacers 19. First and second deck tiles 6 are then positioned on the sleepers 17 and 18 against the boards 22 and 24. A second board 24 is screwed to the adjacent spacers 19 along the outside edge of the second tile 6 to complete one-half of a border around the top of the patio assembly (FIG. 10).

Figure 11:
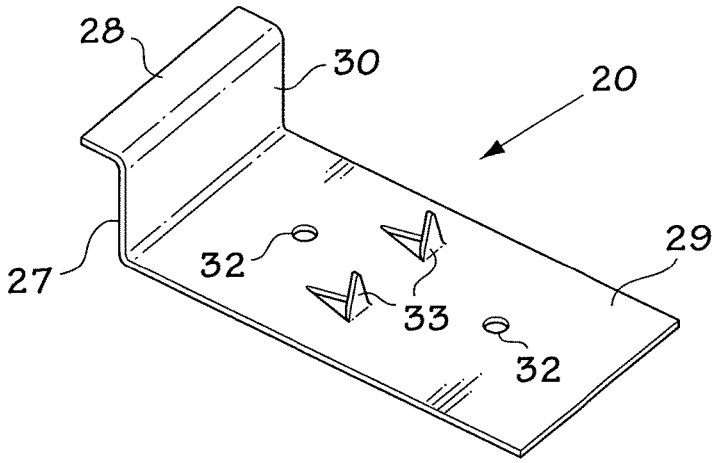
FIG. 11 is an isometric view of a deck clip used in the second embodiment of the patio assembly.
Figure 12:
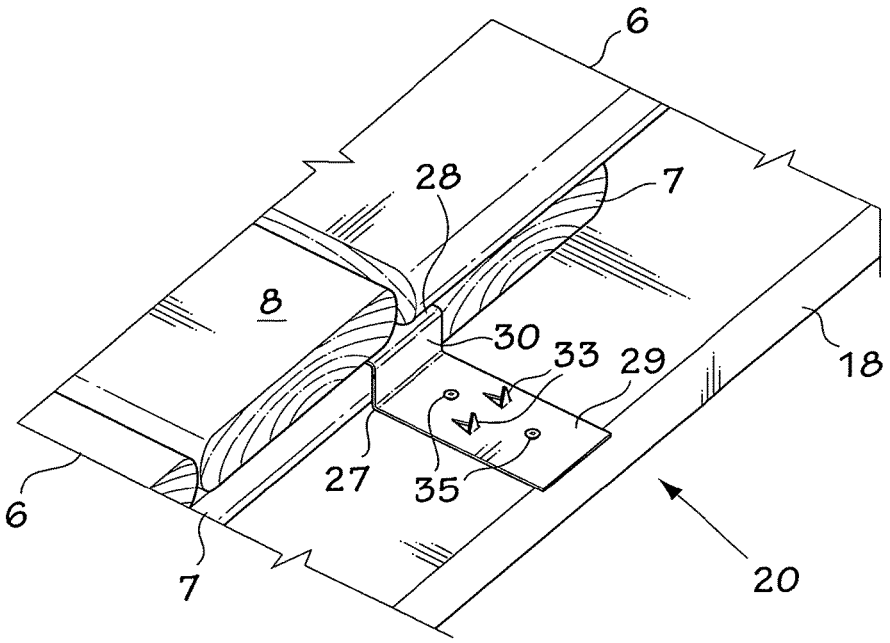
FIGS. 12 to 14 are isometric views of a section of the patio assembly showing the mounting of deck tiles using the deck clip of FIG. 11.
Figure 13:
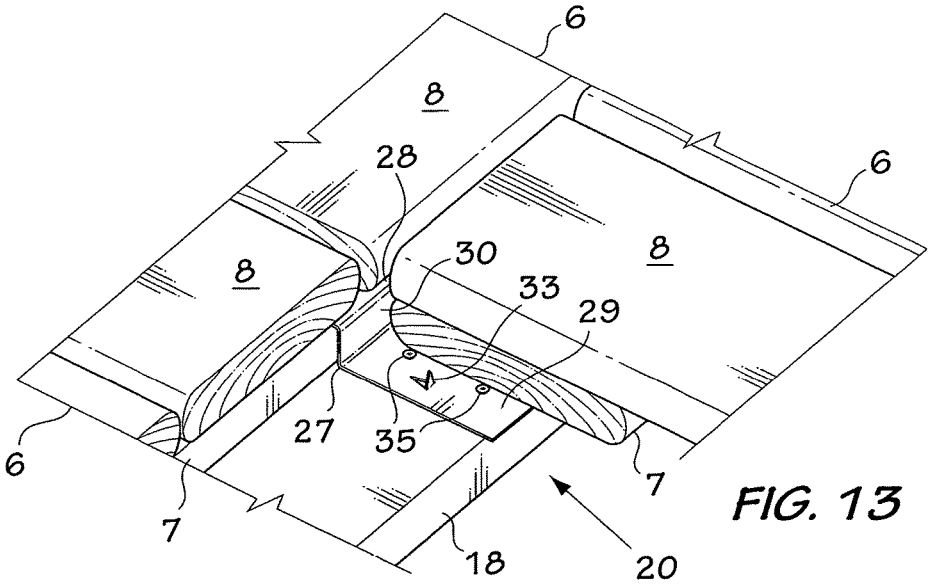
Figure 14:
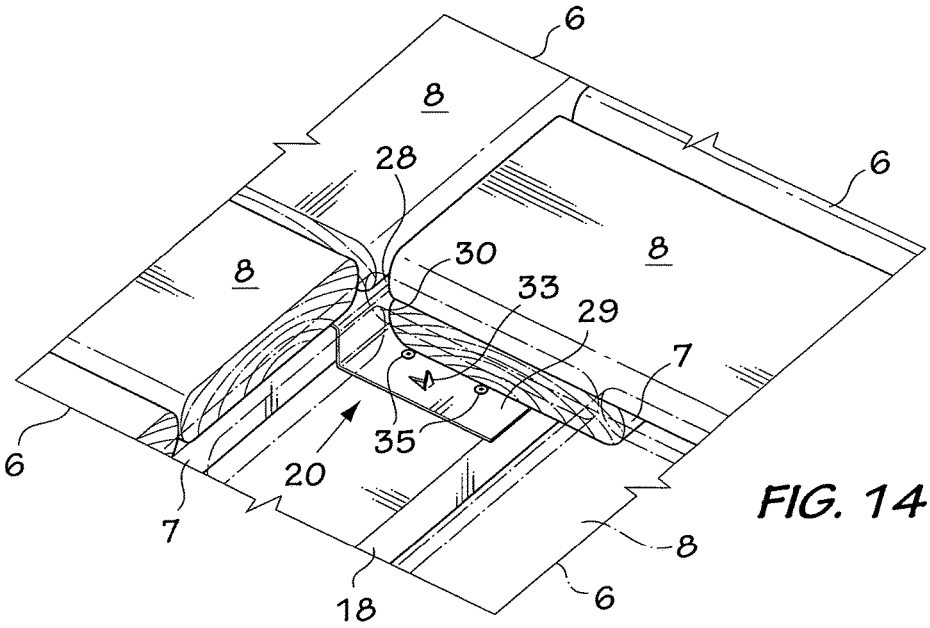

With the corners of the first two deck tiles 6 connected to the base defined by the groundsheet 16, the sleepers 17 and 18, and the spacers 19, a clip 20 is used to connect the inside corners of the first four of six deck tiles 6 to each other and to one of the intermediate sleepers 18. As best shown in FIG. 11, the deck clip 20 is defined by a rectangular strip of material, one end 27 of which is bent to form an inverted L-shaped hook, which includes a top ledge 28, which is connected to a large rectangular base 29 by a vertical web 30. The ledge 28 extends horizontally from the top end of the web 30 in a direction away from the base 29. Holes 32 are provided in the base 29 for receiving fasteners, which connect the slip 1 to a sleeper 18 (FIGS. 12 to 14). Upwardly extending barbs 33 are punched out of the base 29.

Figure 15:
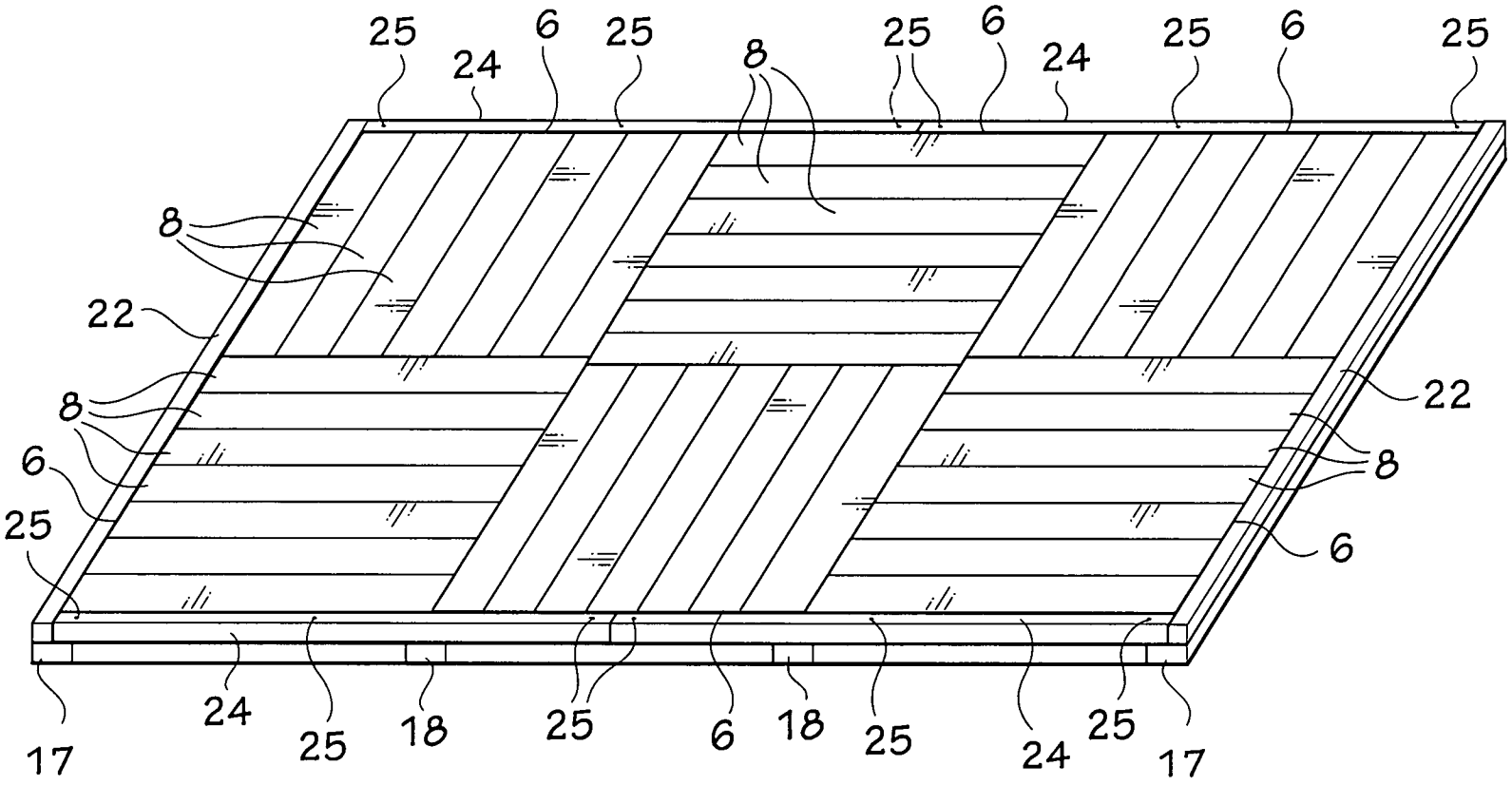
FIG. 15 is an isometric view of the completed second embodiment of the patio assembly of the present invention.
Figure 16:
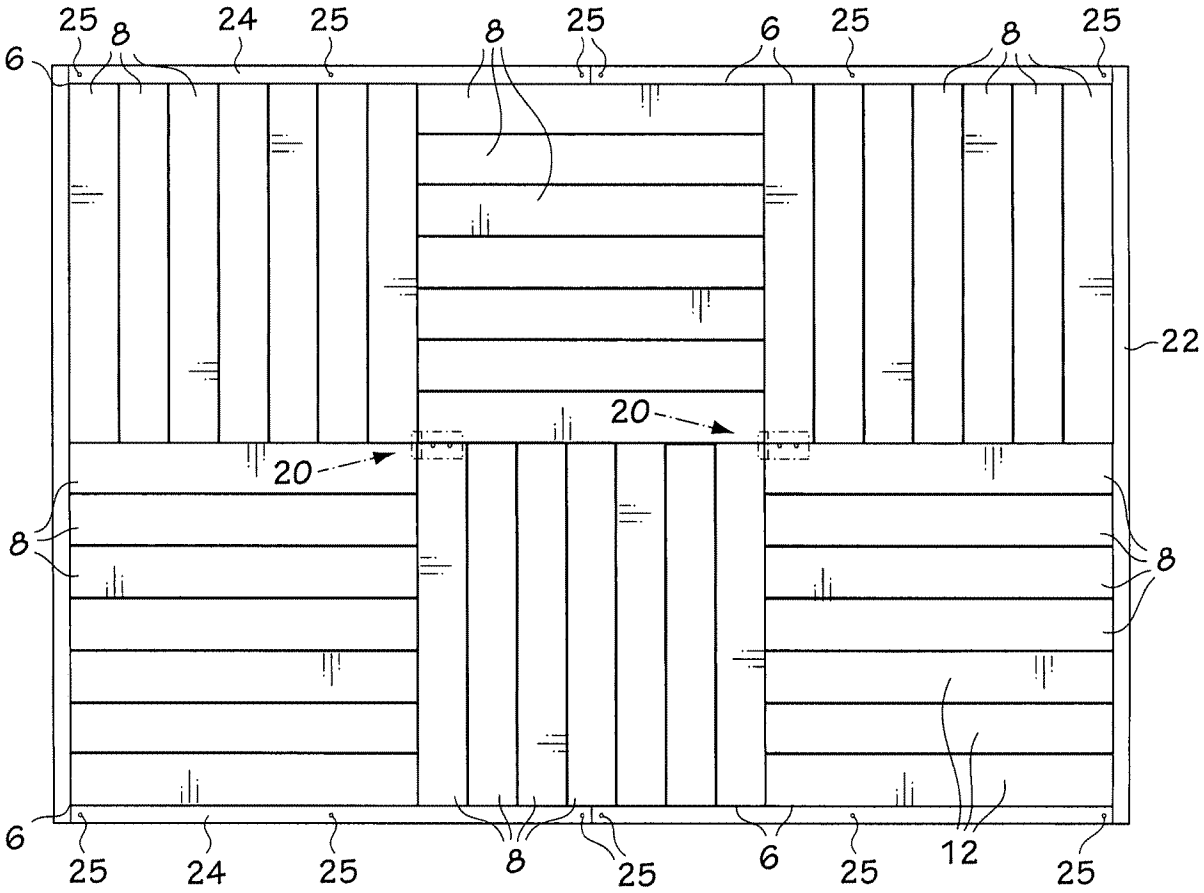
FIG. 16 is a top view of the completed patio assembly of FIG. 15.
Figure 17:
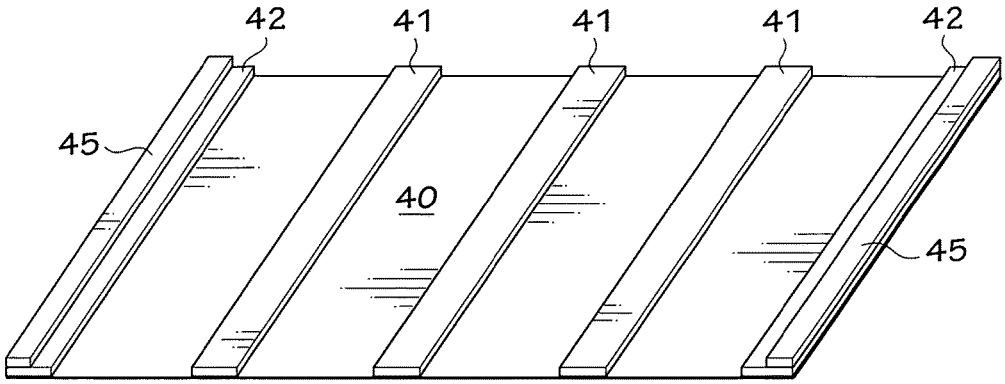
FIG. 17 is an isometric view of a groundsheet and sleepers used in a third embodiment of the patio assembly.

As shown in FIG. 12, the ledge 28 of the deck clip 20 is slid into a position in which one side of the ledge 28 overlaps the inner end of the furring strip 7 of one deck tile 6 and the side of the furring strip 7 of an adjacent deck tile 6. The clip 20 is then connected to the intermediate sleeper 18 using fasteners in the form of screws 35 (FIGS. 12 to 14). A third deck tile 6 (FIG. 13) is placed in a position in which it overlaps approximately one-half of the base 29 of the clip 20. When properly positioned, the ends of the floorboards 8 of the third sleeper 6 are aligned with the longitudinal axis of the sleeper 18. The corner of the third tile 6 overlapping the clip base 29 is pressed or hammered down so that one of the prongs 33 enters the furring strip 7. A fourth deck tile 6 (FIG. 14) is then placed in position over the deck clip 20 with its floorboards 8 extending parallel to the longitudinal axis of the sleeper 18. The corner of the fourth deck tile 6 is then pressed down so that the second prong 33 enters its furring strip 7. A third board 24 is screwed to the spacers 19 in end-to-end relationship with the first board 24. A second clip 20 is then mounted on the second intermediate sleeper 18 at the inner corners of the second and third deck tiles 6 and then the fifth and sixth deck tiles are attached to the second sleeper 18 in the same manner as the third and fourth tiles. Finally, a fourth board 24 is attached to the other ends of the sleepers 17 and 18 to complete the border around the tiles 6. As shown in FIGS. 15 and 16, the top of the deck tiles 8 is in the same plane as the top of the border.

Figure 18:
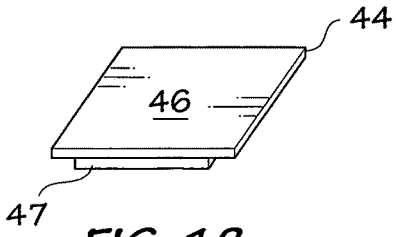
FIGS. 18 and 19 are isometric views of a deck tile used in the third embodiment of the patio assembly.
Figure 19:
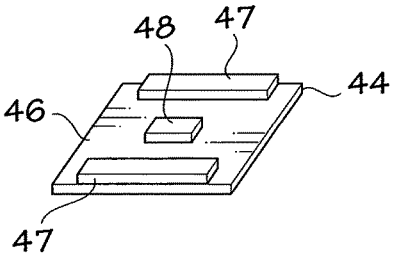

Referring to FIGS. 17 to 21, a relatively simple third embodiment of the invention includes a groundsheet 40 formed of landscape fabric (FIG. 17), a plurality of spaced apart, parallel sleepers 41 and 42 permanently attached to the groundsheet using staples (not shown) or other fasteners, and a plurality of pre-assembled, square deck tiles 44 (FIGS. 18 and 19). Narrow boards 45 defining end borders are permanently mounted on and extend the lengths of the end sleepers 42.

As best shown in FIGS. 18 and 19, each deck tile 44 includes a square top plate or floorboard 46, spacers 47 mounted on two opposite ends of the bottom of the floorboard and a strengthening strip 48 (FIG. 19) mounted centrally on the bottom of the floorboard 46. The spacers 47 are shorter than the sides of the floorboards 46 so that the sides of the floorboard extend beyond the ends of the spacers (FIG. 18). The strip 48 ensures that there are no springy areas on a finished patio. While the floorboards 44 shown in FIGS. 18 to 21 are square, the floorboards can be rectangular. At least the top surfaces of the sleepers and the deck tiles are coated with a deck paint or another finish such as a vinyl covering available under the trademark DURADEK or a similar product. After the coating has been applied to the sleepers and the deck tiles, strips of hook and eye fasteners (not shown) are attached to the top surfaces of the sleepers and to the bottom corners of the tile floorboards.

Figure 20:
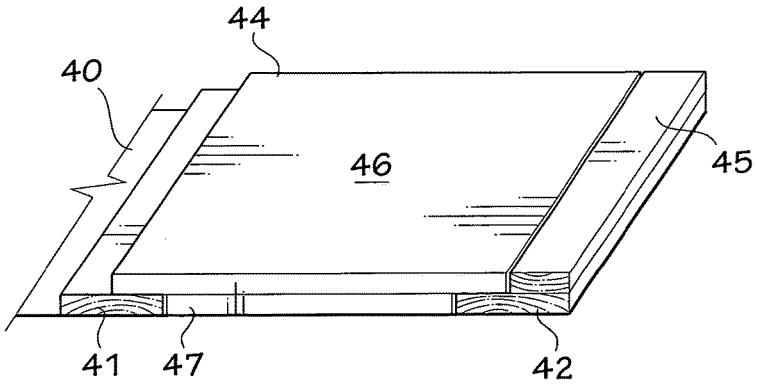
FIG. 20 is an isometric view of one corner of the third embodiment of the patio deck assembly during construction.
Figure 21:
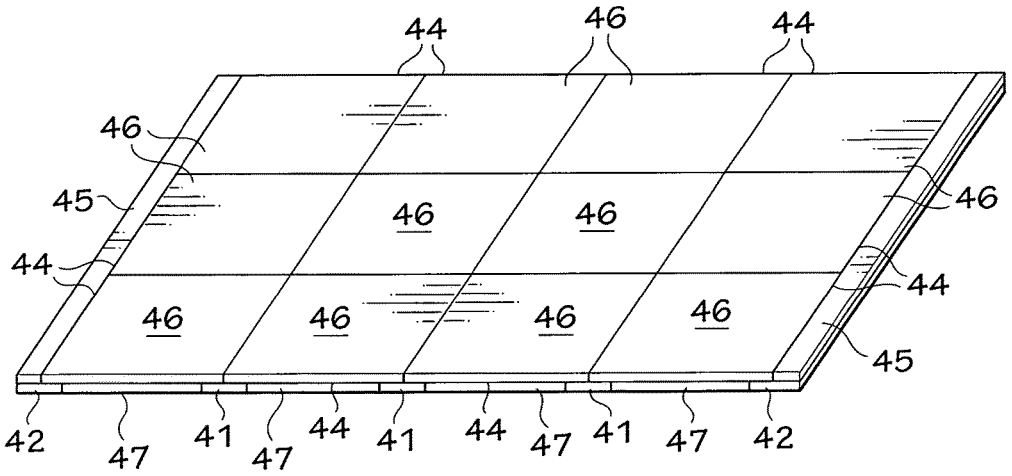
FIG. 21 is an isometric view of the completed third embodiment of the patio deck.

As in the case of the first two embodiments of the patio assembly, the groundsheet 40, sleepers 41 and 42 and the boards 45 would form a more or less cylindrical roll. In order to construct a patio, the groundsheet 40 is unrolled (FIG. 17), and, starting at one corner, the tiles 44 are mounted on the sleepers 41 and 42. As shown in FIG. 20, when the tiles 44 are mounted on the sleepers 41 and 42, with the spacers 47 perpendicular to the sleepers 41 and 42, the sides fo the floorboards at the ends of the spacers 47 overlap the sleepers 41 and 42. The length of each side of the floorboards is such that the floorboards overlap approximately one half the width of the sleeper 41 or 42. The spacers 47 stretch out the groundsheet 40 and keep it flat on the ground. With all tiles 44 mounted on the sleepers 41 and 42, the result is the patio shown in FIG. 21.

The invention claimed is:

1. A modular patio assembly comprising:

a flexible groundsheet adapted to be rolled to form a cylinder;

at least three spaced apart sleepers including two end sleepers and an intermediate sleeper between said end sleepers permanently attached to a top surface of the groundsheet;

two parallel rows of deck tiles mounted on said sleepers, each deck tile including furring strips and floorboards connected to and extending perpendicular to said furring strips;

complementary halves of hook and eye fasteners permanently connected to top surfaces of said sleepers and to bottom surfaces of said furring strips for connecting said deck tiles to said sleepers; and spacers for placement between adlacent sleepers when the groundsheet is unrolled and placed on a surface, the spacers serving to stretch out the groundsheet and space the sleepers apart by distances which ensure vertical alignment of the complementary halves of the hook and eye fasteners.

2. The modular patio assembly of claim 1, wherein said deck tiles are rectangular, the halves of said fasteners on said sleepers are located proximate the ends and at the middle of said sleepers, and the halves of said hook and eye fasteners on said bottom of said deck tiles are located proximate the corners of said deck tiles.

3. The modular patio assembly of claim 2, wherein the deck tiles are square.

4. The modular patio assembly of claim 1, including end border strips permanently attached to the end sleepers for forming a border along opposite ends of the assembly, whereby the groundsheet, sleepers and end border strips can be rolled to form a cylinder.

5. The modualr patio assembly of claim 4 including side border strips for attachment to the sleepers and extending between ends of the sleepers to complete a border around the deck tiles.

6. The modular patio assembly of claim 5 including a deck clip for connecting four corners of adjacent deck tiles to the intermediate sleeper including a planar base, holes in the base for receiving fasteners for connecting the clip to the intermediate sleeper, an inverted L-shaped hook including a web extending upwardly from one end of the base and a planar ledge extending horizontally from the top end of the web in a direction away from the base, the ledge having an outer free end for insertion between the floorboards and furring strips of two adjacent deck tiles, and barbs extending upwardly from the base on each side of the longitudinal axis of the base for engaging and retaining the furring strips of third and four deck tiles.

7. A modular patio assembly comprising:

a flexible groundsheet adapted to be rolled to form a cylinder;

at least three spaced apart sleepers including two end sleepers and an intermediate sleeper between said end sleepers permanently attached to a top surface of the groundsheet;

two parallel rows of deck tiles mounted on said sleepers, each deck tile including a rectangular floorboard of sufficient length to partially overlap adjacent sleepers when placed thereon complementary hook and eye fasteners permanently connected to the top surfaces of said sleepers and to bottom surfaces of said floorboards for connecting said deck tiles to the sleepers; and spacers attached to a bottom surface of said floorboard for extending between side edges of adjacent sleepers when the floorboard is placed on the sleepers, the spacers serving to stretch out the groundsheet and space the sleepers apart by distances which ensure vertical alignment of the complementary halves of the hook and eye fasteners.

8. The modular patio assembly of claim 7 including a reinforcing strip mounted centrally on the bottom surface of the floorboard for reducing springiness of the deck tiles on a completed patio.

9. The modular patio assembly of claim 8 including a border strip mounted on outer sides of each of the end sleepers for defining end borders on the completed patio and preventing movement of the deck tiles beyond the ends of the groundsheet.

10. The modular patio assembly of claim 9 including border strips extending between the ends of the end and intermediate sleepers for completing a border around the assembly.

11. The modular patio assembly of claim 7, wherein the deck tiles are square.

* * * * *